US006600416B2

(12) United States Patent
Kappe et al.

(10) Patent No.: US 6,600,416 B2
(45) Date of Patent: Jul. 29, 2003

(54) DEVICE FOR VALIDATING AUTHENTICITY FEATURES ON DOCUMENTS OF VALUE AND SECURITY DOCUMENTS

(75) Inventors: Frank Kappe, Rheda-Wiedenbrück (DE); Benedikt Ahlers, Berlin (DE); Roland Gutmann, Berlin (DE); Arnim Franz-Burgholz, Falkensee (DE); Anett Bailleu, Berlin (DE)

(73) Assignee: Bundesdruckerei GmbH, Berlin (DE)

( * ) Notice: Subject to any disclaimer, the term of this patent is extended or adjusted under 35 U.S.C. 154(b) by 0 days.

(21) Appl. No.: 09/916,656

(22) Filed: Jul. 26, 2001

(65) Prior Publication Data

US 2002/0033316 A1 Mar. 21, 2002

Related U.S. Application Data

(63) Continuation of application No. PCT/EP00/00671, filed on Jan. 28, 2000.

(30) Foreign Application Priority Data

Feb. 2, 1999 (DE) ..... 199 03 988

(51) Int. Cl.[7] ..... G08B 29/00

(52) U.S. Cl. ..... 340/514; 340/5.1; 340/5.41; 340/5.86

(58) Field of Search ..... 340/514, 51, 5.4, 340/5.41, 5.8, 5.86

(56) References Cited

U.S. PATENT DOCUMENTS

| | | | | |
|---|---|---|---|---|
| 4,387,112 A | 6/1983 | Blach | ..... | 42/7 |
| 4,442,170 A | 4/1984 | Kaule et al. | ..... | 428/333 |
| 4,558,224 A | 12/1985 | Gober | ..... | 250/461.1 |

FOREIGN PATENT DOCUMENTS

| | | | |
|---|---|---|---|
| DE | 41 26 051 | 2/1993 | ..... B44F/1/12 |
| DE | 197 08 543 | 9/1998 | ..... B44F/1/12 |
| EP | 0 477 711 | 1/1996 | ..... G07D/7/00 |
| EP | 0 633 553 | 7/1998 | ..... G07D/7/00 |

*Primary Examiner*—Daryl Pope
(74) *Attorney, Agent, or Firm*—Norris Mclaughlin & Marcus, P.A.

(57) ABSTRACT

The invention relates to a device for validating authenticity features on documents of value and security documents, especially bank notes, personal documents, plastic cards and similar. The device consists of an automatic testing apparatus into which the bank notes for testing are fed and hereby run through a detector device. The detector device is suitable for detecting and evaluating the electroluminescent properties of the authenticity features.

16 Claims, 3 Drawing Sheets

DEVICE FOR VALIDATING AUTHENTICITY FEATURES ON DOCUMENTS OF VALUE AND SECURITY DOCUMENTS

This is a continuation of international application Serial No. PCT/EP00/00671, filed Jan. 28, 2000, the entire disclosure of which is hereby incorporated by reference.

BACKGROUND OF THE INVENTION

1. Field of the Invention

The present invention relates to an apparatus for validating authenticity features on documents of value and security documents, in particular bank notes which pass through a testing apparatus in a batch processing mode, wherein a detector device detects the authenticity feature and supplies the authenticity feature to a signal processing device.

2. Description of the Related Art

A device of the afore-described type is disclosed, for example, in EP 0 633 533 B1 or EP 0 477711 B1.

Both devices are implemented as so-called bank note testing devices which are capable of testing a large number of bank notes within a relatively short time in continuous operation.

The references cited above, however, are disadvantageously based on image recognition which is time-consuming. This adversely affects the processing capability of such testing devices. In fact, complete images are recognized, i.e., symbols are detected and compared with stored symbols. This requires a decrease in the transport speed during symbol recognition and evaluation so as to allow sufficient computing time for the evaluation and a pass-fail decision.

Moreover, with conventional symbol recognition only visible symbols are detected which is no longer adequate considering the present state of the technology for testing the authenticity of bank notes.

It is a therefore an object of the invention to improve an apparatus of the aforedescribed type for validating authenticity features so that invisible authenticity features can also be evaluated and processed with high quality at significantly greater transport speeds.

SUMMARY OF THE INVENTION

The present invention provides for a system including a detection device which is capable of detecting the electroluminescent properties of the authenticity features in a document of value, security document, bank note, personal document or plastic card. It is an important feature of the invention that the detected electroluminescent properties of authenticity features can be evaluated.

In this way, the apparatus is no longer limited to recognizing optically visible authenticity features, but can also detect and evaluate invisible authenticity features, in particular authenticity features that have electroluminescence properties.

As described in other applications assigned to the same applicant, bank notes can be provided with electroluminescent features. However, it has hitherto not been known to evaluate such authenticity features in automatic testing devices at a high processing speed.

According to a preferred embodiment of the invention, the detector device includes at least two opposing electrodes, with the security document and document of value to be tested moving between the opposing electrodes, with at least one detector capable of detecting the electroluminescence signal of the authenticity features and converting the electroluminescence signal into an electrical signal.

The term "electroluminescence" refers to all phosphorescent and fluorescent elements which produce a corresponding luminescence signal under the influence of an alternating electromagnetic field. This signal need not necessarily be located in the visible spectral range. It can also be located in the IR or UV spectral range; but it can also be located in the visible spectrum. Moreover, the luminescence signal can be located both in the visible and in the invisible spectral range, with the associated detector device capturing and processing this signal.

For producing an alternating electromagnetic field with the frequency approaching several MHz, the alternating electromagnetic field has to penetrate the security document and document of value at the location where the authenticity signal is to be tested. For this purpose, the alternating electromagnetic field is coupled into the security document and document of value. The coupling is preferably capacitive, i.e., the security document and document of value is guided in the field gap between two mutually opposing electrodes, with the respective poles of the electrodes being connected to the signal source to produce the alternating electromagnetic field.

The air gap between the electrodes and the document of value and security document should be as small as possible so as to provide the best possible interaction between the alternating electromagnetic field and the security document and document of value. Preferably, at least one of the electrodes is resiliently pressed against the security document and document of value, so that—by minimizing the air gap—the electric field strength penetrating the security document and document of value is as high as possible.

Such electrodes can be implemented in several ways:

In one embodiment, one of the electrodes can be a two-dimensional electrode, whereas in the other electrode can be formed as a resiliently biased roller placed opposite the two-dimensional electrode. The resilient bias can be produced by resiliently pretensioning the axle of the pressure roller in the transport plane of the document of value and security document, so that the pressure roller resiliently contacts one side of the document of value and security document, whereas the other side of the document of value and security document or bank note contacts the opposing two-dimensional electrode.

The emitted luminescence signal can advantageously be detected by making the two-dimensional electrode transparent for the emitted luminescence signal and by placing the detector device for capturing the luminescence signal on the other side of this electrode. However, the invention is not limited to this embodiment.

In another embodiment of the invention, both electrodes can be formed by respective pressure rollers, wherein at least one of the pressure rollers is pretensioned in the transport plane of the document of value and security document.

In the present and in the preceding embodiment, the cylindrical electrode which is formed as a pressure roller, is assumed to have a conductive coating that is coupled to one pole of the alternating field generator. This can be accomplished by connecting the coating of the pressure roller electrically with the axle of the pressure roller, wherein the axle is pretensioned and electrically isolated from a resiliently biased pressure device. The signal to be coupled to the coating can then be transmitted to the axle via a slip ring contact and transmitted from there to the coating.

In a third embodiment of the invention, two two-dimensional electrodes are provided, wherein at least one of the two-dimensional electrodes is resiliently biased against the other electrode. In this way, the alternating electromagnetic field can penetrate the bank note that is introduced into the gap between the electrodes without any intervening air gap.

To simplify the setup, at least one of the two-dimensional electrodes is preferably transparent for the luminescence signal. If the luminescence signal is at least partially in the visible spectral range, then at least one of the electrodes is formed of a transparent electrically conductive material (e.g., indium tin oxide), which can furthermore be colored like, for example, a filter disk so as to transmit a narrow band of the captured luminescence signal to the detector located on the other side of the transparent electrode.

However, if the emitted luminescence signal is in the invisible spectral range, then at least the one electrode needs to be transparent only for the spectral range of the luminescence signal and can be opaque in the visible spectral range.

The detector device can located so as to detect only a predetermined track on the bank note to be tested. Alternatively, several detector devices can be arranged side by side, or a detector device can have two detectors for evaluating the luminescence signal. With the latter embodiment, only the difference signal is advantageously evaluated which is unaffected by external parameters (for example, temperature fluctuations, ambient humidity, and moisture in the security document and document of value).

Forming the difference between two detector devices hence increases the reliability for evaluating the detected luminescence signal.

The invention will hereinafter be described a greater detail with reference to the drawings which illustrate several embodiments. Additional features and advantages of the invention which are important for the invention, will become clearer from the drawings and the description.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements throughout the several views.

DETAILED DESCRIPTION OF THE PRESENTLY PREFERRED EMBODIMENTS

Figure 1:
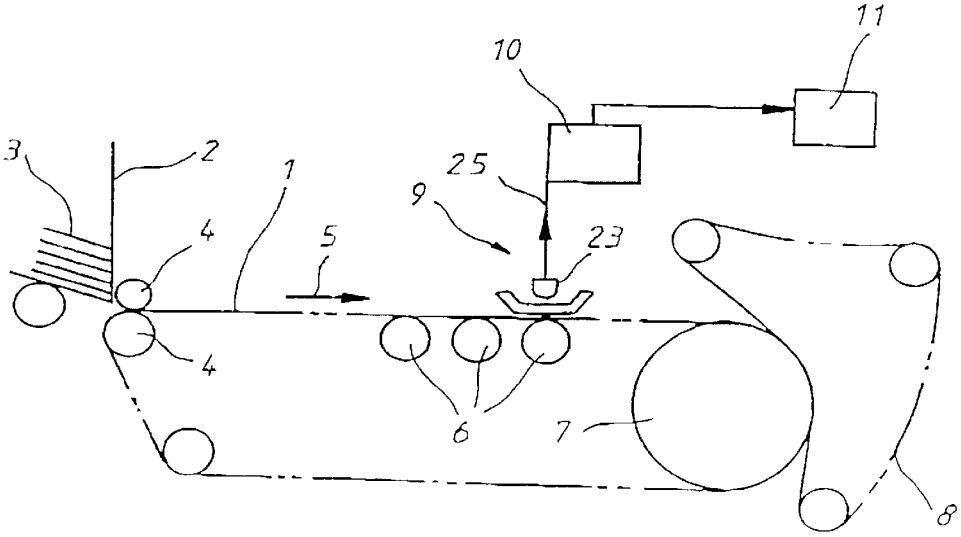
FIG. 1: schematically, a side view of a testing apparatus according to the invention.

The testing device of FIG. 1 consists essentially of a transport belt 1 which is driven in the direction of arrow 5. A stack with documents of value and security documents 3 is positioned in a feed chute 2, wherein a single bank note is pulled in by the draw-in rollers 4 and conveyed in the direction of the arrow 5 to the detector device 9 on the transport belt 1.

A number of transport rollers 6 and a deflection roller 7 are illustrated, with the transport belt 1 being driven only by a separately driven drive belt 8.

However, the invention is not limited to this embodiment. The transport belt 1 can also be driven by at least one of the transport rollers 6 or the deflection roller 7.

Instead of a transport belt 1, other conveying means can be used, such as chain conveyers, link conveyers, gripper drives and the like.

Also not shown are additional testing devices that can be associated with the testing device, such as testing devices for detecting optically visible authenticity features and the like.

When the authenticity feature is detected, an electroluminescence signal is produced in the region of the detector device 9, which is captured by a detector 23 and supplied to a signal processing device 10 via a line 25. The signal processing device 10 can be connected to a display device 11.

Figure 2:
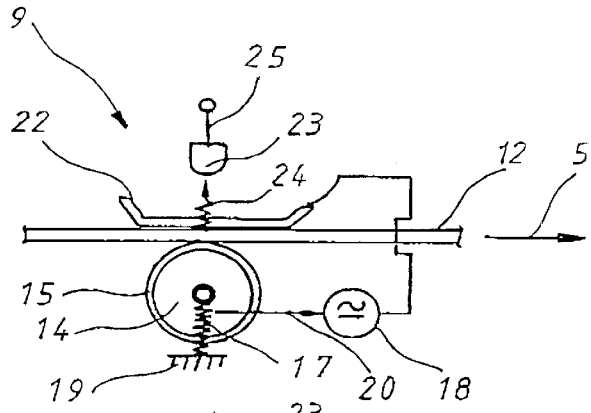
FIG. 2: an enlarged representation of a first embodiment of a detector device.

In the embodiment of FIG. 2, the detector device 9 includes a pressing roller 14, with the axle 16 of the pressing roller 14 being pressed by a spring 17 against the bank note 12 to be tested. The pressing roller 14 has a conductive coating 15 connected via a the line 20 to a terminal of a signal source 18.

The spring 17 is supported by a stationary support 19.

The other terminal of the signal source 18 is connected via the line 21 with an electrically conducting guide foil 22 that is located on the opposite side of the security document and document of value 12. Accordingly, an alternating electromagnetic field is produced between the coating 15 and the guide foil 22, which penetrates the security document and document of value 12 approximately perpendicular to its surface. As soon as a luminescent authenticity feature 27–32 (see FIG. 4) reaches the area of this detector device 9, a luminescence signal 24 is produced which is incident on the detector 23 and produces in the line 25 a signal which is captured and processed by the signal processing device 10.

Figure 3:
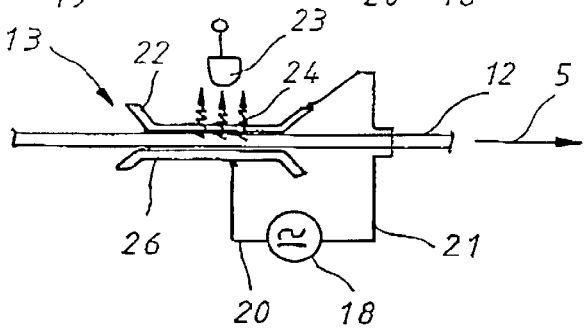
FIG. 3: an enlarged representation of a second embodiment of a detector device.

As shown in FIG. 3, a detector device 13 consists of two approximately two-dimensional opposing guide foils 22, 26, with the bank note 12 to be tested being transported between the foils in the direction of the arrow 5. At least one of the guide foils 22, 26 can be resiliently pretensioned against the other guide foil.

For sake of clarity of the drawings, detector 23 is shown is having a gap relative to the respective upper guide foil 22. However, this feature is not necessary; instead, the detector 23 can be placed close to the respective guide foils 22 so as to produce the shortest possible path to minimize scattering of the luminescence signal 24.

Figure 4:
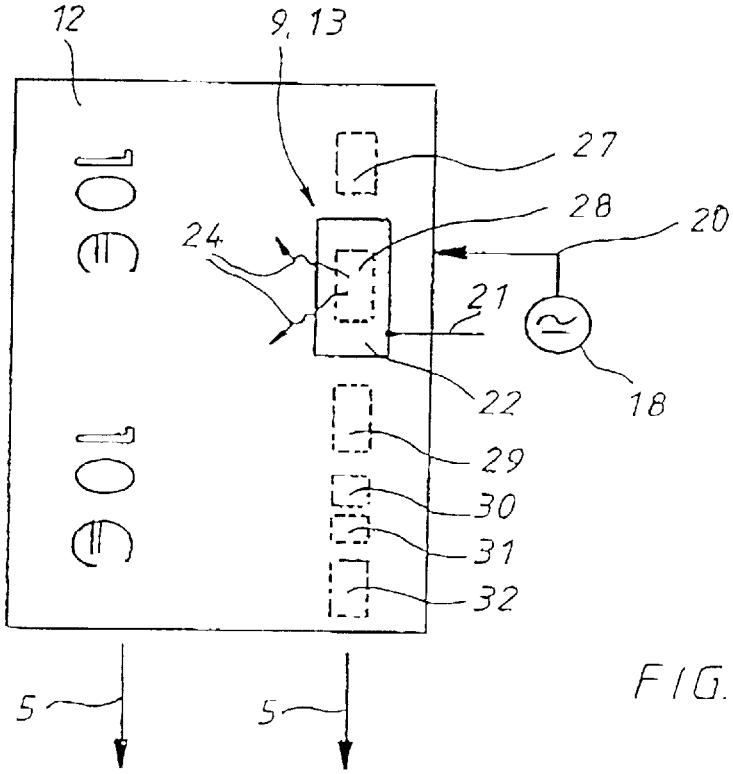
FIG. 4: schematically, a top view of a bank note to be tested with an arrangement of the detector device.

As shown schematically in FIG. 4, the detector device 9, 13 can be arranged only at a single track of a bank note 12, i.e., the width of the detector device transverse to the transport direction (direction of arrow 5) can be smaller than the width of the security document and document of value 12.

It will also be appreciated that several authenticity features 27–32 having different lengths and optionally also different widths can be arranged along this track, wherein the succession of these authenticity features during the transport of the security document and document of value 12 through the detector device 9, 13 produces a time-dependent luminescence signal 24 which can also be used for verifying the authenticity of the security document and document of value.

Alternatively, several detector devices 9, 13 can be arranged side-by-side or sequentially on the document of value and security document 12, so that not just a single track, but also several tracks can be evaluated.

In yet another embodiment, the transport of the document of value and security document can be briefly interrupted during the testing period. The transport of the document and value and security document then resumes after the testing is complete.

Figure 9:
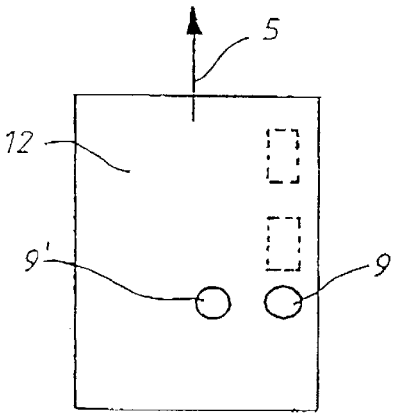
Figure 10:
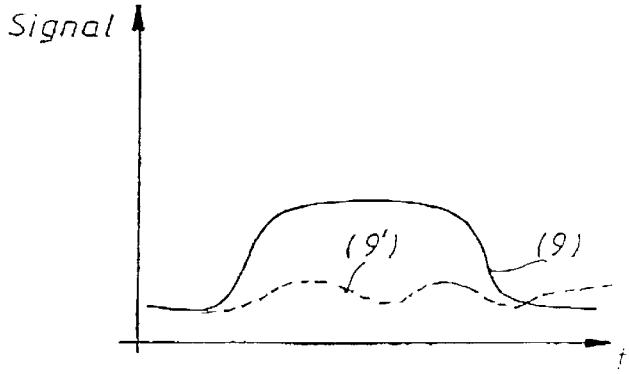
FIG. 10: the signal produced during scanning with two detectors according to FIG. 9, FIG. 11: a top view of an electrode arrangement with finger-type electrodes.

Reference is made here to FIGS. 9 and 10, which show two detectors 9, 9' scanning a bank note 12. Whereas the detector device 9 is associated with the track having the authenticity features 27–32 to be scanned, the second detector device 9' is not associated with any authenticity feature, but rather scans the surface of the document of value and security document.

The signals of the two detectors 9, 9' are illustrated schematically in FIG. 10. As seen in FIG. 10, errors can be eliminated by forming the difference between the signal of the detector device 9 and the detector device 9'. Such errors can be caused, for example, by temperature fluctuations, unintentional illumination of the sensor device (detector 23) as well as by other error sources.

When two detector devices are arranged sequentially, the difference signal between the first and the second detector device can be evaluated.

The arrangement of the invention advantageously allows an improved authenticity check of documents of value and security documents by evaluating invisible authenticity features 27–32. Since there is no need to recognize patterns, the evaluation can be performed at high-speed. Only the presence or absence of a luminescence signal in certain regions of the security document and document of value has to be checked.

The processing speed of a testing device equipped with the detector device can therefore be increased significantly.

Figure 5:
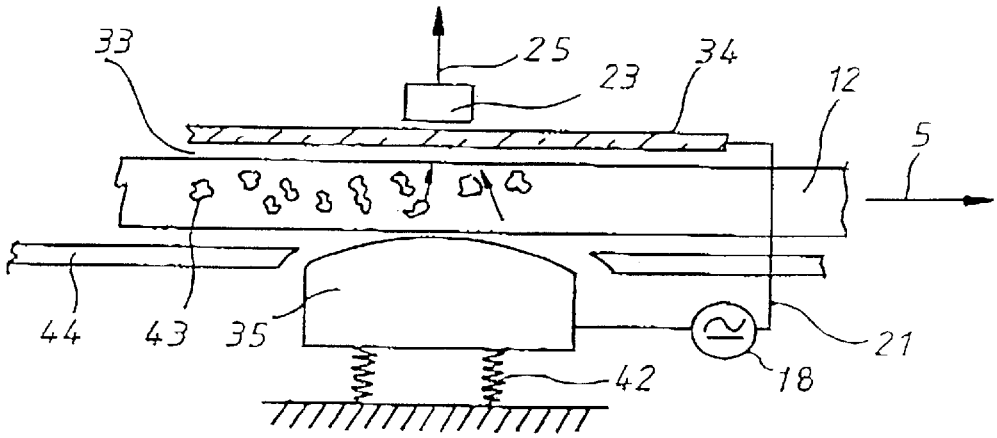
FIG. 5: schematically, in cross-section, another embodiment of a testing device according to the invention.

FIG. 5 shows another embodiment, wherein at least one of the electrodes is implemented as an ITO-foil or as a glass plate. In this way, a plate electrode 34 is formed which is at least partially electrically conducting and electrically connected via line 21 with one terminal of the signal source 18. The other electrode is formed as an electrode head 35 which is pressed by springs 42 against one side of the bank note 12 to be tested.

To simplify the drawings an air gap 33 between the bottom side of the plate electrode 34 and the top side of the security document and document of value 12 is shown. This air gap 33, however, should ideally be excluded and eliminated so as to produce a high flux density in the region between the bottom side of the plat electrode 34 and the top side of the electrode head 35. Air gaps 33 cause problems and should therefore be avoided. For this reason, springs 42 are provided which resiliently press the security document and document of value 12 against the surface of the plate electrode 34.

The electrode head 35 is disposed in an opening of a support plate 44 which also represents the transport plane for the security document and document of value 12.

Schematically illustrated are electroluminescent elements 43, which in the present embodiment are embedded in the material of the security document and document of value 12. However, the invention is not limited to this embodiment.

Such EL-elements 43 can also be applied as a coating on the document of value and security document 12, with the coating being applied either on one side or on both sides.

Figure 6:
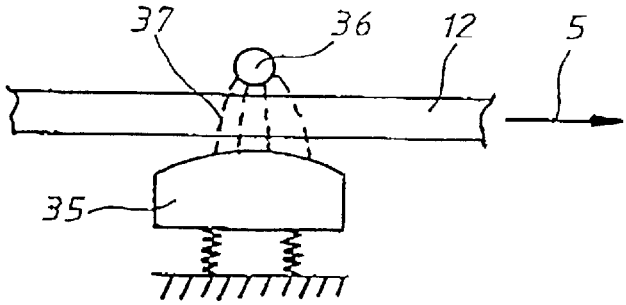
FIG. 6: an embodiment different from that depicted in FIG. 5, FIG. 7: an embodiment with electrodes shaped differently than those of FIGS. 5 and 6, FIG. 8: an embodiment with electrodes shaped differently than those of FIG. 7, FIG. 9: schematically, a top view of two detectors for scanning a bank note.

FIG. 6 shows that a round electrode 36, which in the simplest form is a conducting wire, replacing the plate electrode 34. The resulting field lines 37 penetrate a bank note 12 to be tested substantially normal to the surface, terminating on the surface of the electrode head 35.

Figure 7:
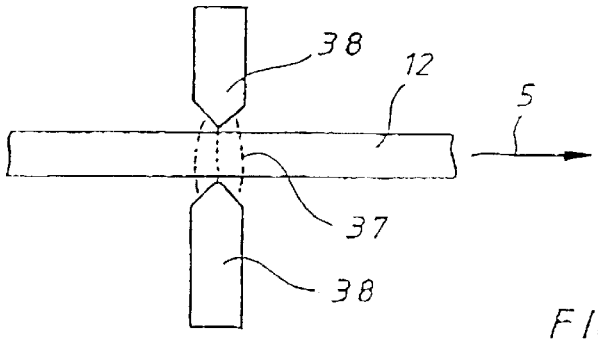

In yet another embodiment, several parallel wires or a grid of electrically conductive wires can be provided. Although the wire material is not transparent in these embodiments, the electroluminescence of the document of value and security document can still be tested. As depicted in FIG. 7, the round electrode 36 and the electrode head 35 can be replaced by two opposing pointed electrodes 38 which produce a particularly high and concentrated electric field having field lines 37.

The security document and document of value 12 in this case passes through the gap formed between the two opposing pointed electrodes 38.

Figure 8:
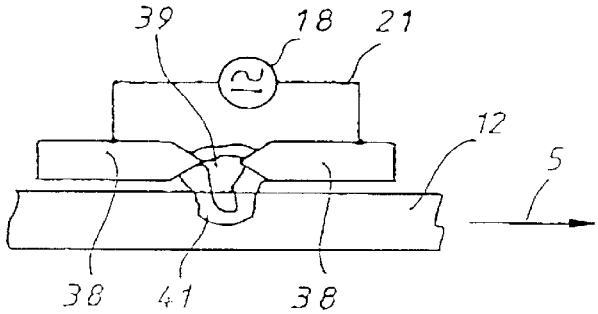

FIG. 8 shows a modification of the embodiment of FIG. 7, wherein the two electrodes 38 which do not necessarily have to have a pointed shape are arranged side-by-side.

According to another embodiment, the laterally arranged electrodes can also be implemented as comb-like structures. The comb-like structures can engage with one another, with the evanescent electric field exciting the electroluminescent layer in the document of value and security document to cause light emission.

Field lines 41 are formed in the electrode gap 39 between the electrodes. The field lines 41 extend partially outside the bank note to be tested, but also extend partially inside the material of the security document and document of value, causing the EL-elements 43 embedded therein to emit light.

Figure 11:
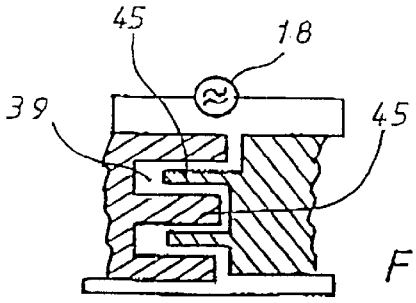
Figure 12:
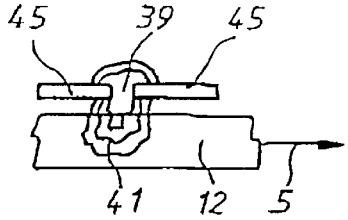
FIG. 12: the arrangement of FIG. 10 in cross-section.

FIGS. 11 and 12 show an embodiment different from that of FIGS. 7 and 8. The electrode arrangement consists of interdigitated finger-type electrodes. The magnetic field is concentrated in the electrode gap (flux gap) formed between the interdigitated electrodes.

The electrode arrangement is located on one side of the bank note 12, with the field lines penetrating the bank note. In this way, the EL-elements embedded in the bank note or a applied to the bank note are excited and emit a luminescence signal 24.

The drawing does not show that the processing speed (transport speed in the direction of the arrow 5) of the security document and document of value can be varied. For example, the security document and document of value can be pulled into the testing device for the document of value and security documents at a high-speed. The transport speed of the security document and document of value through the detector device 9 is then lowered when the authenticity features are measured according to the present invention. Alternatively, the security document and document of value can be temporarily stopped when the authenticity features are detected by the detector device 9, so as to obtain a respective output signal. In other words, the transport speed of a security document and document of value 12 does not necessarily have to remain constant.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. An apparatus for validating authenticity features on a document of value, security document, bank note, personal document or plastic card, the apparatus comprises:

a testing device accepting the document of value, security document, bank note, personal document or plastic card provided from a batch processor;

a detector for detecting an authenticity feature and supplies the authenticity feature to a signal processing device;

a transport device transporting the document of value, security document, bank note, personal document or plastic card from the batch processor through the detector;

the authenticity features include electroluminescent properties;

the detector includes at least one electrode for producing an electric field, the electrode being resiliently pressable against the surface of the document of value, security document, bank note, personal document or plastic card.

2. The apparatus according to claim 1, wherein the detector comprises at least two opposing electrodes that produce an alternating electric field therebetween, and the document of value, security document, bank note, personal document or plastic card to be tested is moved between the at least two opposing electrodes.

3. The apparatus according to claim 2, wherein one of the at least two opposing electrodes is approximately two-dimensional and the other electrode is formed as an electrically conducting coating of a pressure roller.

4. The apparatus according to claim 2, wherein each of the least two opposing electrodes are formed approximately two-dimensional.

5. The apparatus according to claim 3, wherein at least one of the electrodes is transparent for EL-signal of the authenticity feature.

6. The apparatus according to claim 3, wherein at least one of the electrodes is transparent for the EL-signal of the authenticity feature and the signal is transmitted to the detector through an optical waveguides located proximate to the at least one electrode.

7. The apparatus according to claims 1, comprising two detectors arranged with a mutual offset in the transport direction.

8. The apparatus according to claim 1, wherein the at least one electrode is formed as a plate electrode.

9. The apparatus according to claim 1, wherein at the least one electrode is formed as a round electrode.

10. The apparatus according to claim 1, wherein the at least one electrode is formed as a pointed electrode.

11. The apparatus according to claim 1, wherein the at least one electrode includes a plurality of electrodes located on one side of the a document of value, security document, bank note, personal document or plastic card.

12. The apparatus according to claim 7, wherein an output signal is obtained by a difference between the authenticity features detected s by the two detectors.

13. The apparatus according to claim 2, wherein the detector converts the detected electroluminescence properties into an electrical signal.

14. The apparatus according to claim 5, wherein the detector is located in close proximity to the at least one of the electrodes.

15. The apparatus according to claim 8, wherein the plate electrode is made of a transparent electrically conducting material.

16. The apparatus according to claim 15, wherein the transparent electrically conducting material is indium tin oxide.

* * * * *